US005320289A

United States Patent [19]

Hashish et al.

[11] Patent Number: 5,320,289

[45] Date of Patent: Jun. 14, 1994

[54] ABRASIVE-WATERJET NOZZLE FOR INTELLIGENT CONTROL

[75] Inventors: Mohamad Hashish, Kent; David Monserud, Seattle; Steve Craigen, Auburn, all of Wash.

[73] Assignee: National Center for Manufacturing Sciences, Ann Arbor, Mich.

[21] Appl. No.: 930,847

[22] Filed: Aug. 14, 1992

[51] Int. Cl.[5] ..... B05B 7/14; B05B 7/28

[52] U.S. Cl. ..... 239/434; 239/587.4; 239/600; 51/439

[58] Field of Search ..... 239/428, 434, 600, 587.4; 51/439; 83/177

[56] References Cited

U.S. PATENT DOCUMENTS

| | | | |
|---|---|---|---|
| 4,478,368 | 10/1984 | Yie | 239/600 X |
| 4,711,056 | 12/1987 | Herrington et al. | 51/439 X |
| 4,817,874 | 4/1989 | Jarzebowicz | 239/600 X |
| 4,951,429 | 8/1990 | Hashish et al. | 51/439 |
| 5,092,085 | 3/1992 | Hashish et al. | 51/439 |
| 5,144,766 | 9/1992 | Hashish et al. | 51/439 |
| 5,155,946 | 10/1992 | Domann | 239/434 X |

*Primary Examiner*—Andres Kashnikow
*Assistant Examiner*—Lesley D. Morris
*Attorney, Agent, or Firm*—Don R. Mollick

[57] ABSTRACT

An abrasive waterjet nozzle for intelligent control is illustrated. The invention includes a nozzle cartridge dismountably attached to a holder allowing quick and automatic nozzle changes. Provisions are further included for sensing the condition of nozzle components.

17 Claims, 3 Drawing Sheets

ABRASIVE-WATERJET NOZZLE FOR INTELLIGENT CONTROL

FIELD OF INVENTION

This invention pertains to the machine shaping of materials by use of an abrasive waterjet, in particular the invention pertains to an abrasive waterjet nozzle design adapted for monitoring, automated control, and assembly.

BACKGROUND OF THE INVENTION

Abrasive waterjet systems are used in many industries. The primary use of abrasive waterjet systems is trimming parts created by other tools. Industries often view abrasive waterjets as a rough cutting tool only. This view is too limited. The abrasive water jet is of use as a precision machining tool for such applications as drilling, turning and milling. These functions are routinely accomplished today by automated systems. Abrasive waterjets have not been widely used in automated systems for the reasons outlined below.

Waterjets are used to cut materials. A waterjet cutting system includes a source of high pressure fluid and a nozzle. The nozzle includes a pierced jewel or orifice and a housing to contain the orifice. The jet emerges from the orifice when high pressure liquid fills the housing. The jet is the actual cutting tool. Many ingenious mountings and systems of joints and seals connect the nozzle to a source of high pressure liquid. Waterjet cutting systems are routinely used to cut relatively soft materials to precise shapes. Precise cutting of sheet goods with minimal material wastage is a typical application.

Abrasive waterjets developed recently are increasingly used in manufacturing industries. An abrasive waterjet system entraps a finely divided abrasive material in a jet of high pressure liquid. First, a waterjet is created as in a waterjet cutting system. Abrasive material is supplied to the waterjet in a chamber. The waterjet with abrasive material is shaped and formed by a mixing tube before reaching the workpiece.

The nozzle for such a system must include several components. A high pressure connector is required to connect the nozzle to a supply of high pressure liquid. The high pressure connector is customarily a metal to metal seal. A jewel orifice is used for forming a waterjet. A source of abrasive and means of conveying the abrasive to the nozzle is needed. A means for mixing abrasive and the jet from the jewel orifice and forming a jet are essential functions of the nozzle. The mixing and forming functions are accomplished by an erosion resistant mixing tube. In such a nozzle the liquid pressure is very high, on the order of tens of thousands to hundreds of thousands of pounds per square inch. A suitable housing is required to hold all these components together.

As would be expected in such a system various portions wear with use. In particular, jewels, although made of extremely hard materials, break or erode. The mixing tube is exposed to rapidly moving abrasive. This causes the mixing tube to erode and require replacement. In all existing systems replacement of the jewel and/or mixing tube requires disassembly of the nozzle system.

Disassembly and subsequent reassembly is done by hand on current nozzle systems. Hand assembly is needed because the high pressures used require the use of metal to metal seals for assembly of the housing. Metal to metal seals demand a high tightening torque for assembly. This is because the pressure between the seal members must be greater than the difference between internal and external pressures. The various components of the nozzle must be very accurately aligned . Minor misalignment of the jewel, jewel mount or mixing tube can adversely affect the operation of the system. The dual requirements of high torque and accurate alignment demand hand assembly.

The necessity for periodic manual disassembly of the nozzle limits the use of abrasive waterjets in automated systems. In order to replace the worn components the system must be turned off and manufacturing interrupted. The worn part must be replaced by hand and the device reassembled. This stops the manufacturing process. In a production line this is intolerable. If automated replacement of worn components were possible abrasive waterjets could be used in many more manufacturing applications. Consequently, there is a demand for an abrasive waterjet system adapted to automated control.

In addition to automated replacement of worn components an automated system requires a means of detecting when the component must be replaced. In current manual systems the worker knows when a mixing tube or orifice must be replaced because the device stops functioning, In an automated system this is too late. Consequently, provision must be made for monitoring the condition of components prone to wear.

SUMMARY OF THE INVENTION

The invention provides an abrasive waterjet system adapted for automated manufacturing. The invention further provides a means for monitoring the condition of wearing components in the nozzle. The components in the nozzle are contained in a cartridge which is easily replaceable. No hand assembly is required to replace a cartridge. The cartridge holds all components which need to be accurately aligned in the necessary collinear orientation.

The nozzle of the invention includes two subassemblies. The first subassembly, the nozzle head, includes connections to sources of high pressure liquid, abrasive, vacuum, and sensing lines. The nozzle head further includes a sealing means for sealing to the second subassembly, an alignable cartridge. The nozzle head further includes means for locking and seating the registered alignable cartridge. All of the above components are situated in a suitable high pressure housing.

The second subassembly, the alignable cartridge, includes a jewel jet forming orifice. The orifice is provided with an alignable mounting which further provides a passage for monitoring jewel condition. The cartridge further provides a second mounting for holding a mixing tube. The jewel mounting is movable relative to the second mounting to allow precise alignment of the jet in the mixing tube. The second mounting further includes passages for flow of abrasive. The mixing tube is firmly held by the second mounting.

In addition to the above components a complete system includes an alignment fixture for aligning and assembling cartridges and a loading fixture for holding cartridges after alignment preparatory to insertion into the nozzle head.

DETAILED DESCRIPTION OF THE FIGURES

Figures 1, 2:
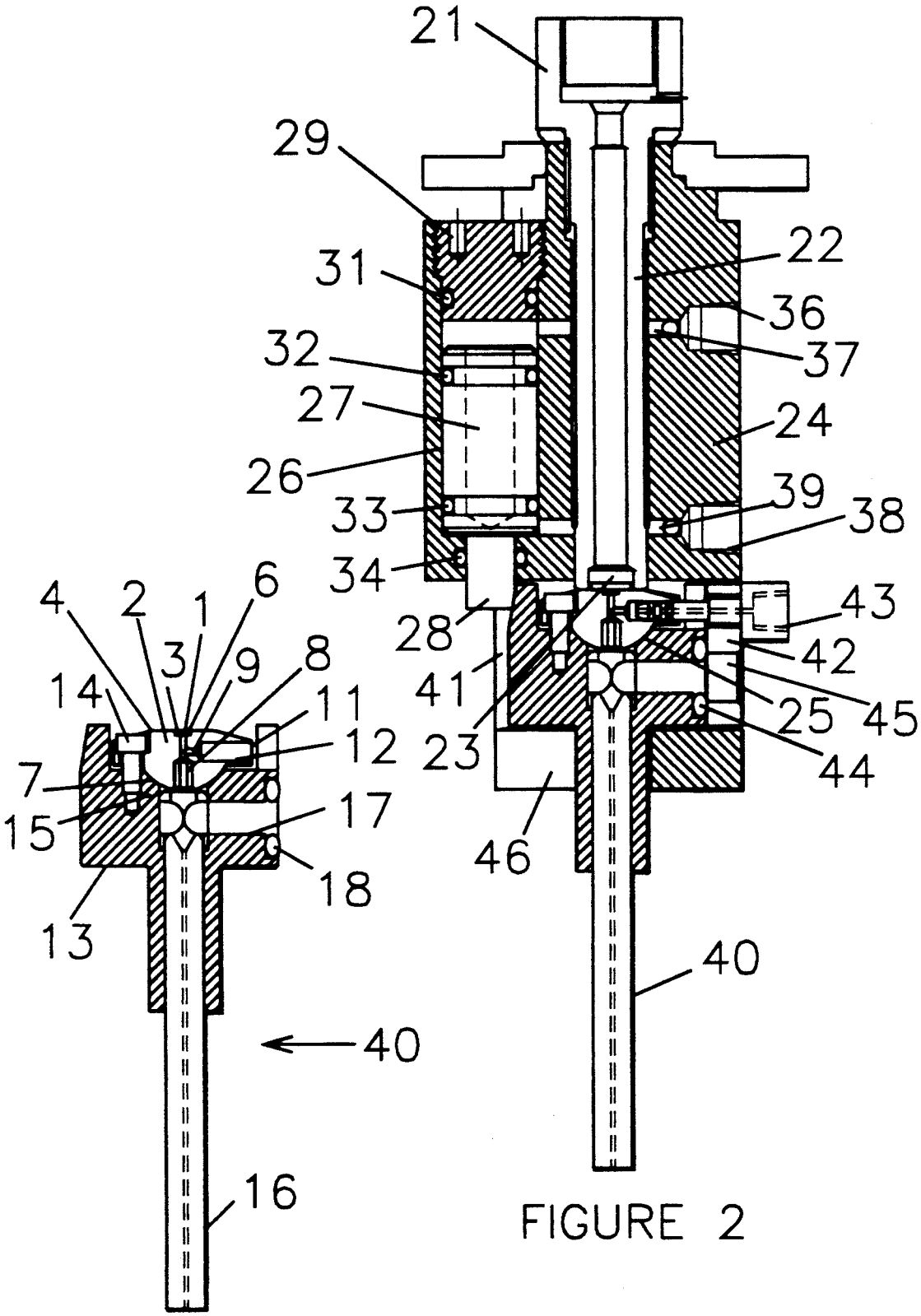
FIG. 1 is a side elevation section view of the cartridge of the nozzle assembly of the invention.
FIG. 2 is a side elevation section view of the nozzle head and cartridge of the invention.

FIG. 1 is a side elevation section view of the cartridge of the nozzle assembly of the invention. The cartridge includes an orifice 1. Orifice 1 is preferably a disc shaped synthetic jewel with a central hole. Such jewel orifices are commonly used in waterjet cutting applications. Orifice 1 is attached to a jewel mounting body 2. Attachment is preferably accomplished by an elastomeric washer 3 between orifice 1 and jewel mounting body 2. In this embodiment, jewel mounting body 2 includes a flat surface 4 on one side. Flat surface 4 is a sealing surface for allowing a seal to form a high pressure connection. Surface 4 also includes a cavity 6 for receiving orifice 1 and washer 3. The opposite surface 7 of jewel mounting body 2 is a sphere shaped section in this embodiment. Rounded surface 7 allows the alignment of orifice 1 in two degrees of freedom. A cavity 8 for passage of any liquid jet emerging from orifice 1 connects surface 4 to surface 7. A jewel health sensing port 9 connects cavity 8 to side 11 of jewel mounting body 2. Port 9 includes a portion 12 for receiving a sealed sensor probe. Jewel mounting body 2 is attached to a cartridge body 13 by alignment screws 14. In this embodiment three such screws are used on the points of an equilateral triangle although only one such screw 14 is shown in FIG. 1. Alignment screws 14 allow both the attachment and alignment of jewel mounting body 2. A spherical or conical surface 15 is provided for engagement with surface 7 of jewel mounting body 2. Cartridge body 13 further includes a mounting means for mounting a mixing tube 16 on the end opposite jewel mounting body 2. In some embodiments it may be desirable to mount mixing tube 16 to cartridge body 13 by means of a mixing tube collet (not shown). Two ports 17 are provided in cartridge body 13 for inlet and egress of abrasive. In FIG. 1 only one such port 17 is shown. It has been found that such ports may be separated by angles between 20 and 180 degrees. Port 17 is further provided with an O-ring 18 seal to prevent leakage.

Figure 5:
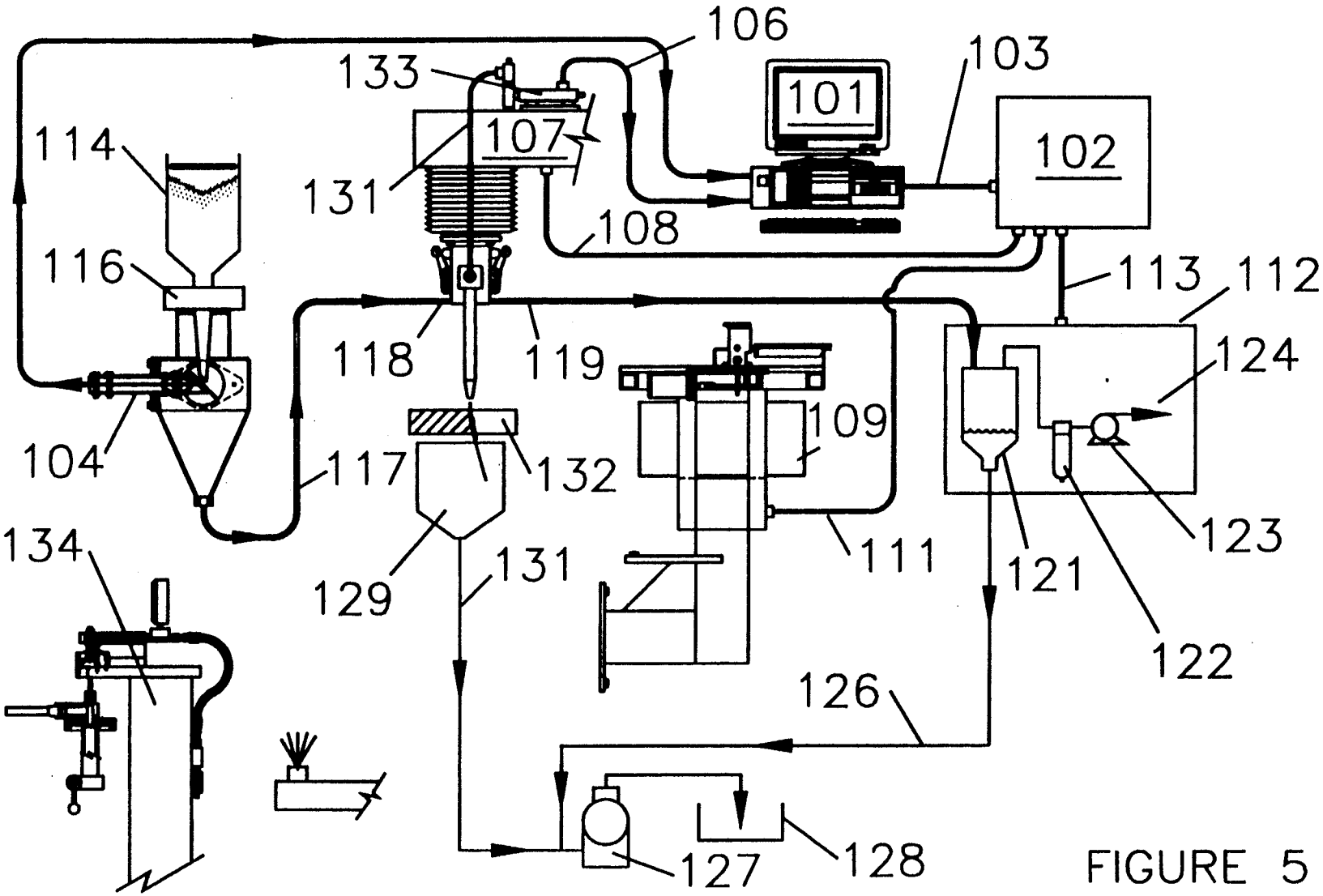
FIG. 5 is a circuit diagram of the system of the invention.

For proper operation it is imperative that the passage through orifice 1 and the center of mixing tube 13 be absolutely collinear. The cartridge is assembled by attaching jewel holder body 2 to mixing tube holder body 13 using three screws 14. Screws 17 are tightened equally to obtain close to symmetric position. Mixing tube 16 is mounted in body 13 and may be secured in place by a collet which insures repeatable mounting relative to body 13. Jewel 1 and washer 3 are inserted in cavity 6. The cartridge may now be aligned on alignment stand 134 (FIG. 5).

FIG. 2 is a side elevation section view of the nozzle head with a second cartridge of the invention. Different components from the FIG. 1 embodiment are indicated. A connection 21 is provided to connect the head to a source of high pressure fluid (not shown). The source of high pressure liquid is typically a hydraulic intensifier or high pressure pump. For automated applications it is desirable that the source be adjustable both in pressure and flow rate. Typical supply pressures are between 10,000 and 100,000 pounds per square inch. Connector 21 is a metal to metal high pressure seal. Attached to and communicating with connector 21 is a supply tube 22. The end of supply tube 22 not connected to connector 21 includes a high pressure dismountable seal 23. Seal 23 is adapted to seal to a flat surface such as that found on cartridge surface 4. Nozzle body 24 surrounds and reinforces supply tube 22. In an alternative embodiment supply tube 22 is replaced by a passage through nozzle body 24. In this embodiment body 24 is provided with a locking cylinder 26. Locking cylinder 26 contains a piston 27 with a wedge shaped bolt 28 attached to one end. The other end of cylinder 26 is closed by a plug 29. O-rings 31,32,33 and 34 seal the interior of cylinder 26. A locking port 36 communicates between the space between rings 31 and 32 and the attachment point for a activation line 37. An unlocking port 38 communicates between the space between rings 33 and 34 and the attachment point for a activation line 39. The lower portion of body 24 includes a cavity 41 for receiving an alignable cartridge 40. One side of cavity 4]is equipped with a vee-block 42 or two locking pins for aligning any cartridge inserted. Vee-block 42 further includes a connection 43 for a jewel health sensor. Connection 43 in turn includes a narrow tube with O-rings 44 on its outer surface. Vee-block 42 may also include a port 45 for abrasive. The bottom of cavity 41 includes a slot 46 for accommodating the mixing tube end of the cartridge 40.

In this embodiment the cartridge is slightly different from in the FIG. 1.embodiment. The only major change is that cartridge body 13 includes a frusto-conical surface 25. In the FIG. 1 embodiment this surface was a spherical section.

Figure 3:
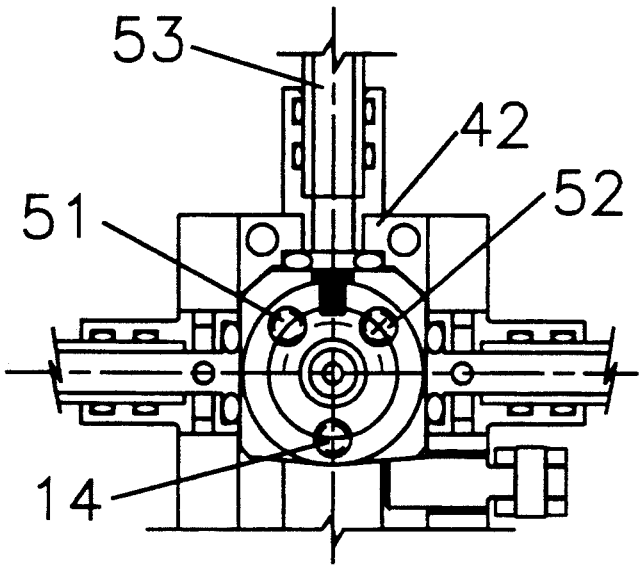
FIG. 3 is a plan section view of the FIG. 2 embodiment.

FIG. 3 is a plan section view of the FIG. 2 embodiment. Alignment screws 14, 51 and 52 are clearly visible in this view. Similarly the shape of vee-block 42 is apparent. It is within the concept of this invention to substitute two round pins for Vee-block 42. In this embodiment vee-block 42 includes the abrasive port 45. The abrasive inlet is a similar port 53 at a 90 degree angle to port 45. The angle is not critical. Abrasive ports could also be 180 degrees apart on either side of the nozzle head. Ports could even be parallel, both entering through vee-block 42.

Returning to FIG. 2, In operation a cartridge 40 is inserted into cavity 41. Insertion may be manual but is preferably accomplished by moving the nozzle head to a loading fixture which includes a plurality of preassembled cartridges. Slot 46 simplifies the insertion procedure. Upon insertion, pressure is applied to port 36 forcing piston 27 and bolt 28 downward. Bolt 28 forces the cartridge against vee-block 42 to secure its accurate position and to seal the Connection for the jewel health sensor 43 and abrasive port 45. When supply pressure is applied to connector 21 seal 23 seals against upper surface 4 portion of the cartridge.

Figure 4:
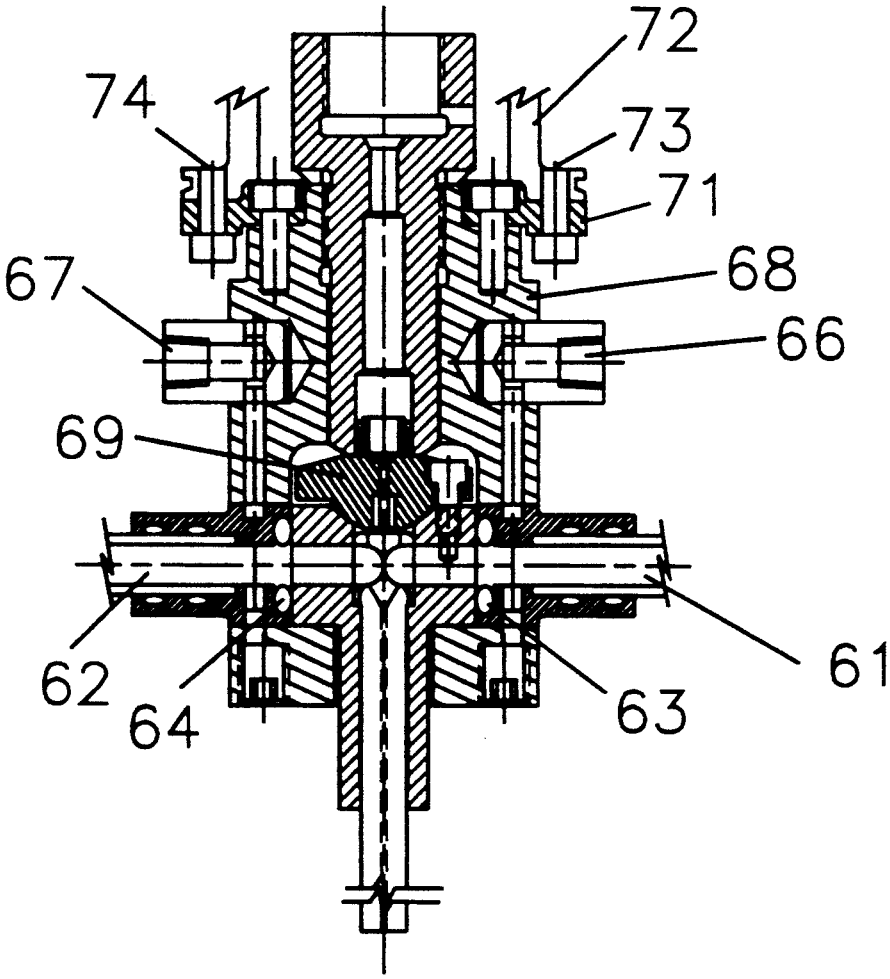
FIG. 4 is a front elevation section of a second embodiment of the nozzle of the invention.

FIG. 4 is a front elevation section of a second embodiment of the nozzle of the invention. Only those parts which differ from the FIG. 2 embodiment will be identified. Two ports 61 and 62 are provided for passage of abrasive through the device. Ports 61 and 62 are provided with O-ring seals 63 and 64 respectively. Port 61 is for inlet of abrasive. Port 62 is connected to a vacuum assist assembly. The result is a flow of abrasive particles between ports 61 and 62. In operation a portion of this flow is captured and entrapped in the waterjet. In this manner an abrasive water jet is created.

The nozzle of this embodiment is further provided with two flushing ports 66 and 67. The first port 66 provides upstream flushing. The second port 67 provides downstream flushing. Additionally, an external flushing port (not shown) may be provided for the area between the nozzle head 68 and cartridge 69. This combination of flushing ports insures that the removal of the cartridge is conducted on clean surfaces.

This embodiment is further provided with an attachment point 71 for attachment to a robot manipulator 72. Attachment is made by means of screws 73 and 74, but it is realized that other equivalent forms of attachment could be used.

FIG. 5 is a circuit diagram of the system of the invention. All functions of the system are controlled by an intelligent nozzle controller 101. Controller 101 can be an electronic computer furnished with suitable software. Inputs to the intelligent nozzle controller 101 include signals from the abrasive flow meter 104 and the jewel health sensor 106. A manipulator controller 102 is connected to controller 101 by data line 103. Manipulator controller 102 in turn is connected to robot manipulator 107 via a two way data line 108. Manipulator controller 102 is further connected to the loading fixture 109 and the vacuum assist assembly 112 via two way data lines 111 and 113 respectively.

Abrasive is contained in an abrasive hopper 114. The flow is controlled by an abrasive flow valve 116. The rate of flow being monitored by an abrasive flow meter 104. After passing meter 104 abrasive flows through abrasive conduit 117 into the inlet port of nozzle assembly 115 emerging through the abrasive exit. In this embodiment nozzle head 115 is similar to that shown in the FIG. 4 embodiment. Abrasive is withdrawn from nozzle 115 via the vacuum assist conduit 119 into vacuum assist assembly 112. Vacuum assist assembly 112 includes means 121 for separating waste from exhaust air. Vacuum assist assembly 112 further includes a trap 122 and vacuum pump 123 and exhaust outlet 124. Waste is withdrawn from vacuum assist assembly 122 down waste line 126 by waste pump 127 for removal to sump 128. Waste pump 127 also removes debris from catcher 129 which includes fragments of the workpiece 132 as well as spent abrasive and liquid.

Conduit 131 from the jewel health sensor port of nozzle assembly 115 is connected to a converter 133 which converts the pressure signal into an electronic signal understandable by controller 101. Upon receiving a signal of jewel deterioration controller 101 through manipulator controller 102 moves manipulator 107 to loading fixture 109. At loading fixture 109 the deteriorated nozzle cartridge is removed and a new cartridge attached. Loading fixture 109 is also controlled by manipulator controller 102 and transmits information on completion of the process. When the new cartridge is installed the manipulator returns to workpiece 132.

Used cartridges are removed to an alignment fixture 134 where the old jewel is removed and a new one inserted. If necessary the mixing tube can also be replaced. Alignment fixture 134 simplifies and tests the alignment of the orifice and mixing tube. When completed the rebuilt cartridge is returned to loading fixture 109. In the present embodiment the rebuilding and alignment of cartridges is done manually but such steps could also be automated.

We claim:

1. A cartridge for insertion into a nozzle assembly including; a body for housing wearable parts, and, a sealing surface attached to said body for sealing to a seal, and a jet forming orifice for forming a jet of liquid, and an alignable mounting attached to said orifice and said body for allowing movement of said orifice relative to said body, and, a mixing chamber downstream of said orifice for mixing liquid and abrasive, and, a port for introducing abrasive into said mixing chamber, and, a mixing tube directly downstream of said mixing chamber for mixing and accelerating abrasive into any jet emerging from said orifice and, wherein said sealing surface is located on said alignable mounting, and wherein said alignable mounting further comprises sensing means for sensing the health of said orifice.

2. A cartridge in claim 1 wherein said sensing means includes a port in said alignable mounting for connection to a pressure sensor.

3. A cartridge as in claim 1, wherein said alignable mounting includes a spherical section shaped surface opposite said sealing surface for rotatable attachment to a shaped surface in said body.

4. A cartridge as in claim 1, wherein said shaped surface in said body is spherical in shape.

5. A cartridge as in claim 1, wherein said shaped surface in said body is frusto conical in shape.

6. A cartridge as in claim 1, wherein said cartridge includes a plurality of screws connecting said alignable mounting to said body.

7. An improved abrasive liquid jet system of the type which includes a liquid jet emerging from an orifice with means for mixing abrasive into said liquid jet and entrapping and accelerating said abrasive into said liquid jet in a mixing tube, the improvement comprising: housing said orifice and said mixing tube in a replaceable cartridge, and wherein said cartridge further comprises, means for aligning said orifice and said mixing tube into a collinear orientation, and wherein said aligning means includes a housing for housing said orifice, a holder for holding said mixing tube attached to said housing by a joint and means for fixing an attachment between said housing and said holder, and wherein said joint is a ball and socket joint, and wherein said means for fixing the attachment between said housing and said holder is at least one screw, and wherein said housing further includes, means for monitoring the condition of said orifice.

8. An improved abrasive liquid jet as in claim 7, wherein said housing includes a first passage for allowing a liquid jet to pass through said housing and said means for monitoring the condition of said orifice includes a second passage from said first passage to the outer surface of said housing.

9. An improved abrasive liquid jet as in claim 7, wherein said means for monitoring further includes means for sensing pressure changes in said second passage.

10. A nozzle assembly for an abrasive water jet machining tool comprising: coupling means for attaching said nozzle assembly to a source of high pressure liquid; and, a pressure body attached to said coupling for containing high pressure fluid and having a recess for receiving a cartridge; and, a seal attached to said pressure body for sealing to a surface; and, a cartridge for insertion into said pressure body including; a cartridge body for housing wearable parts, and, a sealing surface attached to said cartridge body for sealing to said seal, and a jet forming orifice for forming a jet of liquid, an alignable mounting attached to said orifice and said cartridge body for allowing movement of said orifice relative to said second body, and, a mixing chamber downstream of said orifice for mixing liquid and abrasive, and, a port for introducing abrasive into said mixing chamber, and, a mixing tube directly downstream of said chamber for mixing and accelerating abrasive into any jet emerging from said orifice.

11. A nozzle assembly as in claim 10, wherein said alignable mounting further comprises sensing means for sensing the health of said orifice.

12. A nozzle assembly as in claim 11, wherein said sensing means includes a port in said alignable mounting for connection to a pressure sensor.

13. A nozzle assembly as in claim 10, wherein said alignable mounting includes a spherical section surface opposite said sealing surface for rotatable attachment to a surface in said cartridge body.

14. A nozzle assembly as in claim 13, wherein said surface in said cartridge body is spherical in shape.

15. A nozzle assembly as in claim 13, wherein said surface in said cartridge body is frusto-conical in shape.

16. A nozzle assembly as in claim 10 wherein said sealing surface is located on said alignable mounting.

17. A nozzle assembly as in claim 10, wherein said alignable cartridge includes a plurality of screws connecting said alignable mounting to said cartridge body.

* * * * *